United States Patent [19]

Blacker, Jr. et al.

[11] Patent Number: 4,704,565

[45] Date of Patent: Nov. 3, 1987

[54] DYNAMICALLY CONVERGING ELECTRON GUN SYSTEM

[75] Inventors: Allen P. Blacker, Jr., Hoffman Estates; John A. Christensen, Des Plaines; Khem K. S. Garewal, Hoffman Estates, all of Ill.

[73] Assignee: Zenith Electronics Corporation, Glenview, Ill.

[21] Appl. No.: 832,568

[22] Filed: Feb. 21, 1986

[51] Int. Cl.[4] ..... H01J 29/58

[52] U.S. Cl. ..... 315/382; 315/368; 313/412

[58] Field of Search ..... 315/368, 371, 382; 313/412

[56] References Cited

U.S. PATENT DOCUMENTS

| | | | |
|---|---|---|---|
| 4,348,617 | 9/1982 | Miyazaki et al. | 315/382 |
| 4,495,439 | 1/1985 | Shimoma et al. | 313/412 |
| 4,555,649 | 11/1985 | Sharma | 315/382 |
| 4,560,910 | 12/1985 | Midland | 315/382 |

*Primary Examiner*—Theodore M. Blum
*Attorney, Agent, or Firm*—Ralph E. Clarke, Jr.

[57] ABSTRACT

An electron gun system according to the invention comprises means including cathode means for developing an electron beam. Main focus lens means, which has a plurality of electrode means situated on a common axis, provide for receiving the electron beam and forming a focused electron beam spot at the screen of the tube. Means are provided for developing and applying to the electrode means potentials effective to form one or more focusing field components between the electrode means. The lens means is so structured and arranged as to cause to be formed between adjacent electrode means at least one focusing field component which is asymmetrical and effective to significantly divert a passed beam from a straight-line path through a predetermined angle. A first of the plurality of electrode means comprises focus electrode means adapted to receive focus voltages for establishing the focal distance of the beams. A second of the plurality of electrode means cooperates with another of the plurality of electrode means to form the asymmetrical field component. Means according to the invention provide for developing and applying a varying voltage to the second electrode means to cause the strength of ther asymmetric field component, and thus the angle by which the beam is diverted, to vary in response to the varying voltage.

5 Claims, 11 Drawing Figures

Fig. 5
PRIOR ART
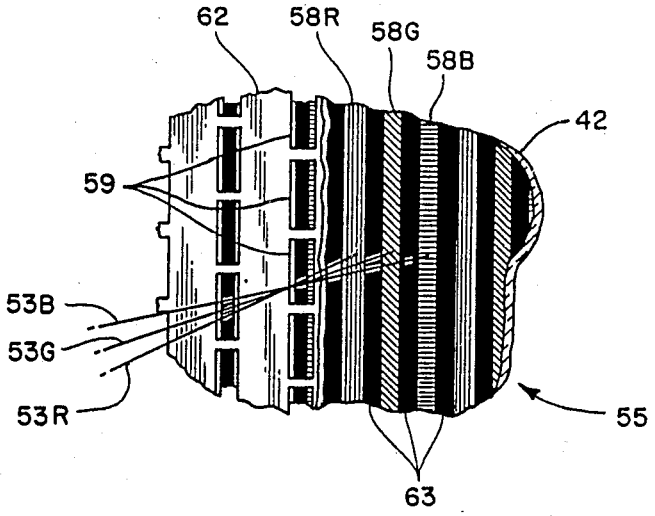
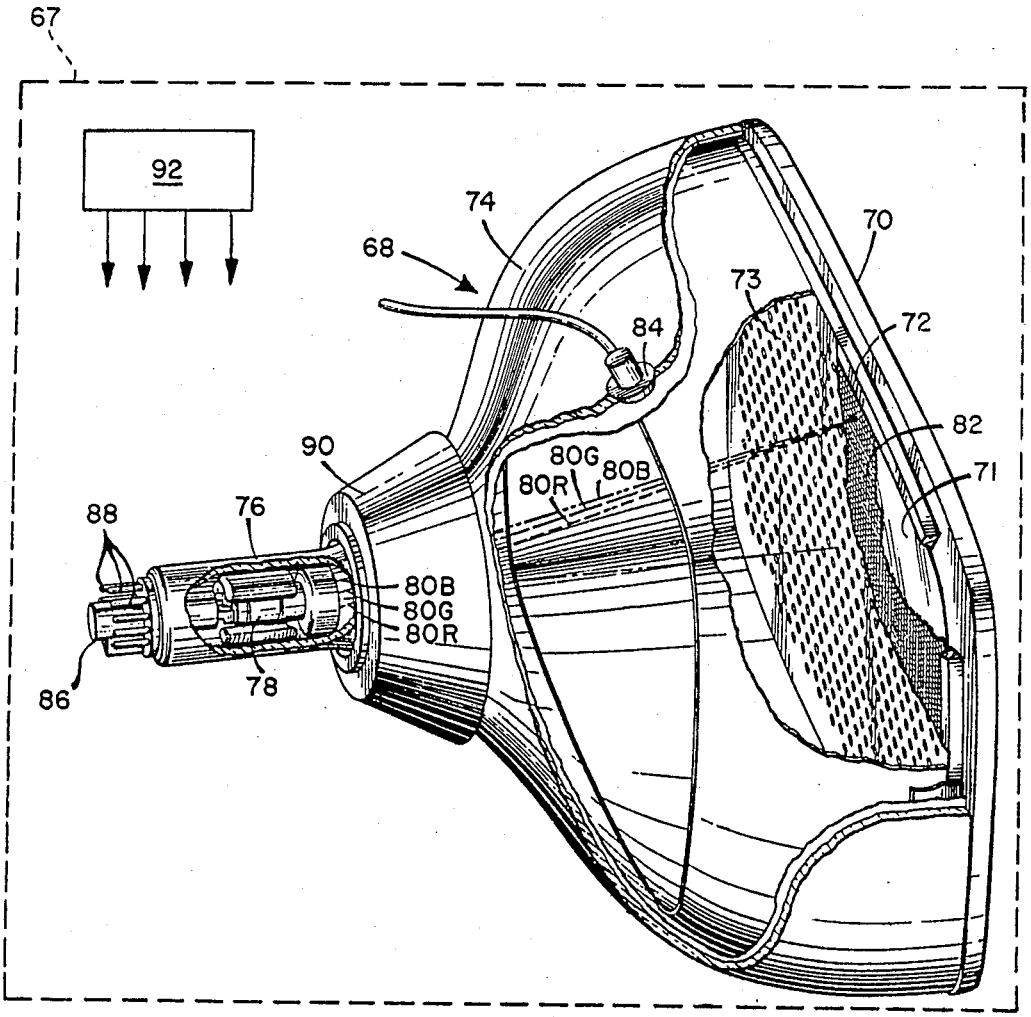
Fig. 6

DYNAMICALLY CONVERGING ELECTRON GUN SYSTEM

CROSS-REFERRENCE TO RELATED APPLICATIONS

This application is related to but in no way dependent upon, the following copending applications of common ownership herewith: Ser. No. 808,137 filed Dec. 11, 1985; Ser. No. 832,493 filed Feb. 21, 1986; and Ser. No. 832,559 filed Feb. 21, 1986.

BACKGROUND OF THE INVENTION

This invention relates generally to an improved electron gun system for television receiver cathode ray tubes that provides at least partial dynamic beam convergence substantially independently of any beam-focus-related adjustments in the main focusing field, and without introducing significant beam distortion. The invention has applicability to all types of color picture tubes and to all types of beam convergence systems including those dependent on the selfconverging yoke and the uniform field yoke. With regard to gun systems, the invention has application to the many types used in home-entertainment television systems and computer display monitors. It also may be advantageously applied to systems that utilize an extended field main focus lens. The dynamically converging gun system according to the invention is particularly useful in improving the image resolution of flat-faced cathode ray tubes which utilize the tension foil mask, and in which degradation of screen corner resolution and edge resolution is particularly troublesome.

Desired picture tube performance characteristics of color television receiver systems include high resolution, picture brightness, and color purity. Resolution is largely a function of the size and symmetry of the beam spots projected by the electron guns of the picture tube. Beam spots are desirably small, round, and uniform in size at all points on the picture screen. Achievement of these ideals is difficult because of the many factors which exert an influence on the configuration of beam spots. As a result of such factors, a beam spot that is small and symmetrical at the center point of the picture imaging field can become enlarged and distorted at the periphery of the field, for reasons which will be described.

Key factors which influence beam spot size, uniformity and symmetry in picture tubes having three-beam electron guns include the following:

(a) electron gun design;
(b) cathode ray tube screen potential;
(c) magnitude of beam current;
(d) the "throw" distance from the electron gun to the screen; and,
(e) the convergence system.

The ability of an electron gun to form small, symmetrical beam spots is a major factor in achieving optimum resolution. The task of designing guns with this capability has become more challenging because of reduction in diameter in the CRT neck. This physical constraint has been largely overcome by new, more effective gun designs, such as the gun having an extended field main focus lens described and claimed in U.S. Pat. No. 3,995,194 assigned to the assignee of this invention.

Convergence of the three beams of an in-line electron gun is provided in present-day television systems primarily by the self-converging yoke. This type of yoke is a hybrid having toroidal-type vertical deflection coils and saddle-type horizontal deflection coils. The yoke contains windings which produce an astigmatic field component that has the effect of maintaining the beams in convergence as they are swept across the screen. An example of a beam-deflecting yoke that provides for self-converging of multiple beams is disclosed in U.S. Pat. No. 3,643,102 to Chiodi. This concept has found wide application in cathode ray display tubes intended for consumer products.

The converging effect is shown highly schematically in FIG. 1, in which an electron gun 10 is depicted graphically as emitting three beams 12, 13 and 14 which diverge from a common plane 16 to impinge on a curved screen 18. The three beams are shown as being converged at the center point 20 of the screen 18. Due to the effect of the self-converging yoke, the three beams are also caused to be in convergence at the side of the screen 18, as indicated by point 22, even though the distance that beams must travel from the plant of deflection 16 to point 22 is greater than from the plane of defection 16 to center point 20 of the screen.

The convergence achieved is not without cost, however, as the beam spots are subject to distortion in the peripheral areas of the screen, as will be shown with reference to FIG. 3. The distortion is acceptable in tubes in which lower resolution is acceptable as the benefits and costs savings implicit in the self-converging yoke outweigh its liabilities.

However, when the screen is flat, as indicated by screen 24 in FIG. 2, the conventional self-converging yoke is unable to maintain beam convergence, as indicated by the spread of the beam spots 28 at the sides 26 of screen 24. In addition to the spread, the spots 28 will be noted as being elongated. This elongation is due primarily to the self-converging feature of the yoke.

The astigmatic field component, while self-converging the beams, undesirably introduces an astigmatic deflection defocusing of the beams when the beams are deflected away from the screen center point. This effect is indicated diagrammatically in FIG. 3 by beam spots 34. The elongation of the beam spots at the peripheries of the faceplate, and the relative increase in spot size, is indicated in greater detail in the inset figure. FIG. 3A. The beam spots 34 will be seen as comprising a bright core 34A, and transverse to the core, a dim "halo," 34B. The center beam spot 36C is shown to illustrate the magnitude of the spot size increase and distortion at the screen corner. Attempts to focus such beams are largely ineffectual due to the astigmatic effect—focusing merely results in what appears to be a "rotation" of the spot in that the core becomes the halo and the halo becomes the core.

As has been noted, the effect is tolerable in conventional tubes where the screen is curved, as shown by FIG. 1, and it is acceptably withn the capability of the self-converging yoke to converge the beams without undue distortion. However, when the screen is flat, as indicated by FIG. 2, the astigmatic effect of the self-converging yoke is no longer tolerable, especially in high-resoiution cathode ray tubes. Any attempt to further modify the configuration of the self-converging yoke field to adapt it to a flat screen will inevitably increase distortion outside the limits of acceptability. The self-converging ability of the yoke was already stretched to its limit in its use with the curved screen before the advent of the flat tension mask tube.

Prior art structures for converging electron beams have relied upon a variety of techniques such as the use of magnetic influences within and/or without the tube envelope, and the use of electrostatically charged plates Also, the prior art shows many examples of inducing beam divergence or convergence by inducing an asymmetry in an electrostatic field formed at the interface of the two spaced electrodes. An example of this approach is found in In U.S. Pat. No. 4,058,753, where there is disclosed a three-beam electron gun for color cathode ray tube having an extended field main focus lens. The focus lens means has for each beam at least three electrodes including a focus electrode for receiving a variable potential for electrically adjusting the focus of the beam. In succession down-beam, there are at least two associated eectrodes having potentials thereon which form in the gaps between adjacent electrodes significant main focus field components. To adjust beam focus, the strength of a first of these components is controlled by adjustment of the voltage received by the focus electrode. The strength of the second of the field components is relatively less than that of the first component. Each of the lens means is characterized by having addressing faces of the associated electrodes which define the second field component being so structured and disposed as to cause the second field component to be asymmetrical and effective to significantly divert the beam from its path in convergence of the beams without any significant distortion of the beam and substantially independently of any beam-focusing adjustments of the first field component. Electrode structures defined for producing asymmetric field components include a gap angled forwardly and outwardly, a wedge-shaped gap, and radially offset apertures.

Beam convergence in delta guns can also be obtained by means of electromagnets positioned 120 degrees apart azimuthally around the tube neck near the beam-emission points of the guns. The fields of the electromagnets are designed to aid or oppose the fields of associated permanent magnet pole pieces used for positioning the beams during set up. The beams can be dynamically converged by the application of voltages to the electromagnets which are modulated at the scanning rates. An example of such convergence means is disclosed in U.S. Pat. No. 3,379,923.

Dynamic convergence is obtained in the electron gun disclosed in U.S. Pat. No. 3,448,316 by adjustment of field potentials at scanning rates. Three in-line electron beams generated by three cathodes cross over in the electrostatic field of a main lens. The center beam (green) follows a straight-line path, but the two outer red and blue beams exit the lens in divergent paths. The outer beams pass through convergence plates which lie parallel to the gun axis and are suspended from the end of the gun nearest the screen. The potential on two outer plates is adjustable to provide for static convergence of the red and blue beams at the aperture mask. The center beam is unaffected as the potential on two inner plates through which it passes is left unchanged. Dynamic convergence is attained by changing the convergence control voltage on the outer two plates at the horizontal scanning frequency. The waveform of the voltage is in the form of a parabola.

In U.S. Pat. No. 4,520,292, von Hekken et al disclose means formed in the screen grid of an electron gun for urging the outer two beams of a three-beam electron gun into convergence with the center beam. The screen grid configuration includes a transversely disposed recessed portion having a substantially rectangular central portion and substantially triangular end parts. The total effect is to the tilt the field lines within the recessed portion so that the outer beams converge.

Other representative disclosures having electrode structures that influence beam convergence includes:

U.S. Pat. No. 3,952,224 to Evans
U.S. Pat. No. 3,772,551 to Hughes
U.S. Pat. No. 4,473,775 to Hosokoshi et al
U.S. Pat. No. 4,513,222 to Chen As has been noted, convergence of the beams of a multiple-beam electron gun will vary as the beams arcuately scan the substantially planiform faceplate. Beam convergence may be achieved dynamically by slightly varying the relative angles of the beams while scanning. In dynamic convergence by circuit means, signals to induce dynamic convergence may be derived from the horizontal and vertical circuits of the television receiver system or monitor to provide a dynamic convergence-correction signal having the characteristlcs of a parabola. The voltage of the convergence-correcting signal is zero at the center of the picture imaging field, and changes towards the sides of the screen to effect convergence. Such dynamic convergence signals may be applied to convergence coils located adjacent to the picture tube neck, or to convergence plates suspended from the end of the gun. Such a dynamic convergence circuit is disclosed by Nelson in U.S. Pat. No. 2,834,911 in which parabolic convergence current waves are obtained by integration of pulse and saw tooth voltage waves in resistive and inductive reactive circuits, acording to the teachings of Nelson.

OBJECTS OF THE INVENTION

Its a general object of the invention to provide an improved electron gun system for color cathode ray tubes.

It is another general object of the invention to provide an electron gun system providing enhanced performance in color picture tubes while reducing component costs.

It is a further object of the invention to provide an electron gun system that enhances resolution and color purity in color picture tubes, especially in peripheral areas of the screen with the result that the deflected beam spots are dramatically smaller.

It is a a less general object of the invention to provide an electron gun system for enhancing uniformity ;n beam spot convergence, especially in peripheral areas of the screen.

It is a more specific object of the invention to provide an electron gun system that makes possible dynamic convergence of the electron beams and that wholly or partially dispenses with the need of a self-converging yoke, and in which a uniform field yoke may be used in lieu of the self-converging yoke in many applications.

It is a specific object of the invention to provide an electron gun system with particular capability for dynamically converging the beams on the screen of a color cathode ray tube having a planar shadow mask and a substantially flat faceplate.

It is another specific object of the invention to provide an electron gun system that makes possible reduction in material and manufacturing costs through less stringent requirements for yoke installation, system set up, lighthousing optics, and mask grading.

BRIEF DESCRIPTION OF THE DRAWINGS

The features of the present invention which are believed to be novel are set forth with particularity in the appended claims. The invention, together, with further objects and advantages thereof, may best be understood by reference to the following description taken in conjunction with the accompanying drawings, in the several figures of which like reference numerals identify like elements, and in which:

FIG. 5 is an enlarged detail view of a section of the faceplate-shadow mask assembly of the tube shown by FIG. 4;

FIG. 6 is a view in perspective and partially in section of a cathode ray tube having a planar mask and associated facepate, with the teevision or display system represented schematically by the enclosing dashed line, in which the dynamically converging gun system according to the invention can be utilized;

DESCRIPTION OF THE PREFERRED EMBODIMENT

The present invention can be embodied in electron guns of several different types both unitized and non-unitized. However, the illustrated embodiments according to the invention are in-line unitized guns as these types are in more general use in color cathode ray tubes.

In the context of the multi-beam color cathode ray tube, this invention may be employed to dynamically converge the off-axis beams all over the screen in common conjunction with the center beam. The convergence means according to the invention is applicable to both the conventional curved faceplate color television display tube depicted schematically in FIG. 4 and to a tube having a planar shadow mask and facepate, as shown by FIG. 6.

Figure 1:
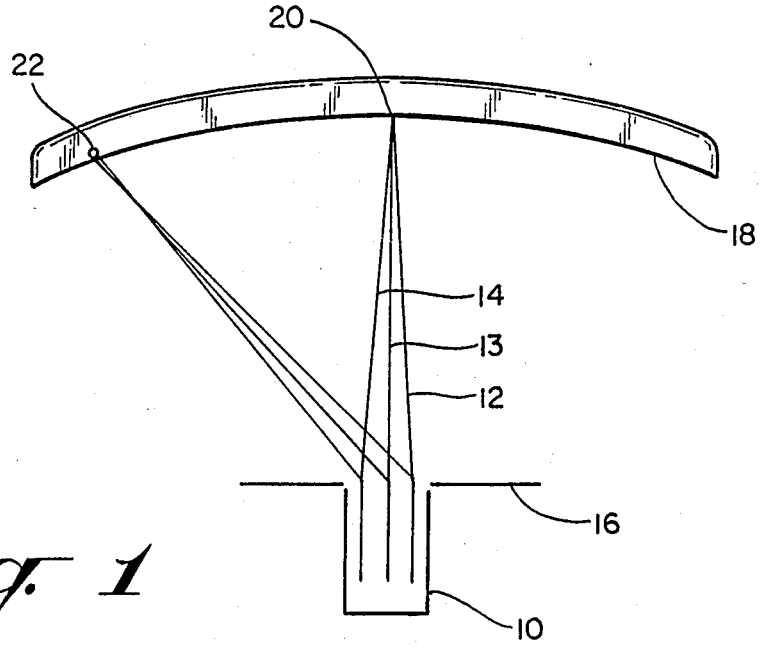
Fig. 1 PRIOR ART
FIG. 1 is a schematic representation of a desired effect of beam convergence on a curved screen due to the astigmatic convergence field components of the self-converging yoke.
Figure 2:
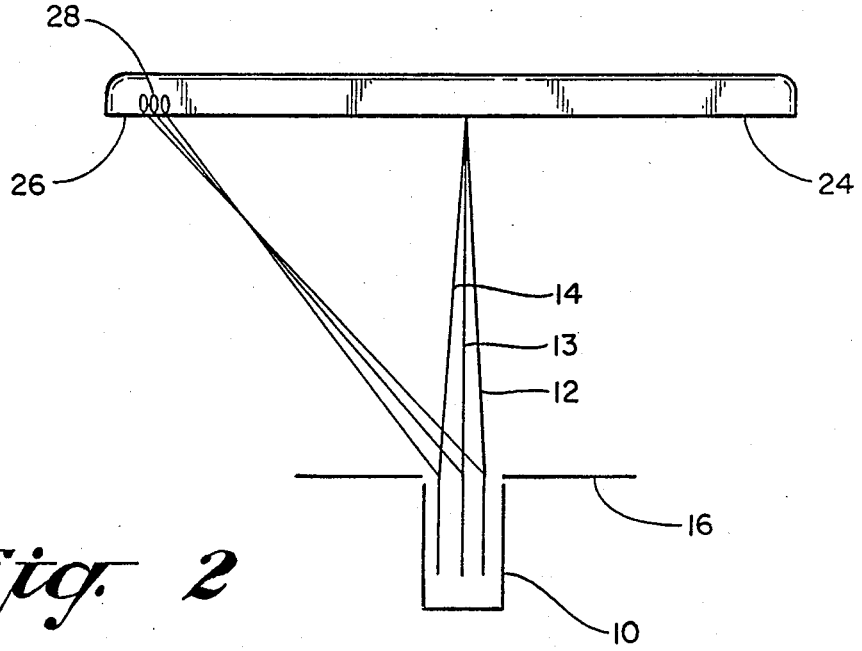
Fig. 2 PRIOR ART
FIG. 2 depicts schematically the undesired effect of the self-converging yoke on beam in peripheral areas of the screen of a cathode ray tube having a flat faceplate.
Figure 3:
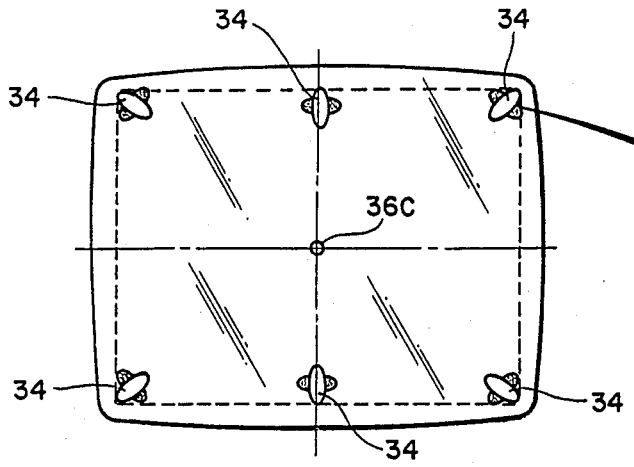
Fig. 3 PRIOR ART
FIG. 3 is a schematic representation of undesired beam spot configuration in corner areas of the screen attributable to the self-converging yoke.
Figure 3A:
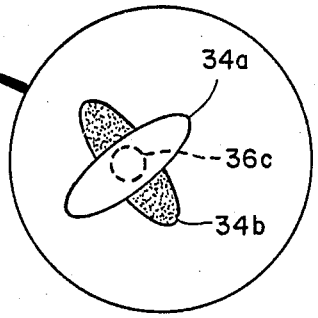
figure 3A is an enlarged view of the undesired beam spot configuration in the screen periphery indicated by FIG. 3.
Figure 4:
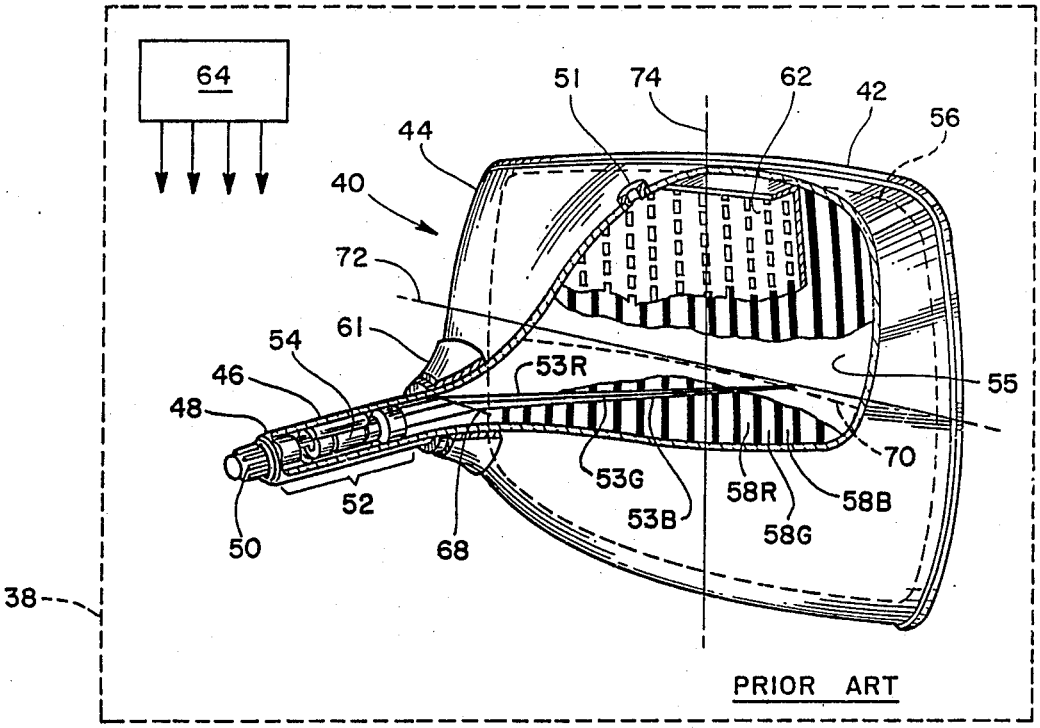
FIG. 4 is a view in perspective and partly in section of line screen cathode ray tube having a curved faceplate as used in a television or display system, with the system concept according to the invention represented schematically by the enclosing dashed line.

FIG. 4 depicts a television receiver or monitor system 38 indicated highly schematically by the enclosing dashed line, in which the dynamically converging electron gun system according to the invention may be advantageously employed. System 38 has a multi-color television line screen cathode ray picture tube 40 of the oonventional type. Tube 40 comprises an evacuated envelope including a curved imaging faceplate 42 having deposits of multi-color emitting phosphors thereon, a funnel 44, a neck 46, and a base 48 through which protrude a plurality of electrical connectors 50 for maklng connection to components located within the sealed envelope of tube 40. An anode button 51 provides for the introduction of high voltage into the tube envelope for tube and gun operation. An electron gun 52, indicated by the bracket, is enclosed in neck 46. Electron gun 52 is represented as being an in-line gun generating three electron beams 53R, 53G and 53B which are focused by a main focus lens 54 of gun 52 onto a phosphor screen 55 deposited on the inner surface of imaging faccplate 42; the boundaries of the screen 55 are indicated by dash line 56. (Please refer also to FIG. 5 which comprises a detailed view of a section of the screen 55 of faceplate 42 of FIG. 4).

Multi-color phosphor targets in the form of stripes of luminescing materials that emit light when excited by an electron beam comprise a red-light-emitting phosphor stripe 58R, a green-light-emitting phosphor stripe 58G, and a blue-light-emitting phosphor stripe 58B, shown as being deposited on the screen 55 of faceplate 42. The targets are arranged in triads each associated with ones of the apertures 59 of adjacently located color selection shadow mask 62, the apertures being in registration with their respective targets. The targets are separated by intervening stripes of a light-absorptive "black surround" 63. The phosphor targets comprising stripes 58R, 58G, and 58B are excited to luminescence by electron beams 53R, 53G and 53B, respectively; the electron beams are caused to scan the screen 55 of faceplate 42 to selectively excite the aforesaid red-light emitting and green-light-emitting targets through the color selection mask 62. Electron beams 53R, 53G and 53B are caused to scan screen 55 by the horizontal and vertical scansion circuit means coupled to yoke 61 which engirds tube 40 in the area of the junction of funnel 44 and neck 46.

The picture or display tube shown by FIG. 4 is the type having a line screen. The invention can also be advantageously employed in the type of picture tube wherein the imaging screen is comprised of a pattern of triads of phosphor dots, the dots of each triad emitting red, green and blue light. As described infra, an adjacent color selection shadow mask has round apertures in registration with the phosphor targets. The electron gun could as well comprise a gun of delta configuration. As with the striped-screen tube, the phosphor dot targets are selectively excited by three scanning beams through the interceding aperture mask.

System 38 includes electrical circuits indicated schematically by the block 64, for supplying potentials for operation of the tube 40 and the included electron gun 52. The electrical circuits provide potentials which form electrical field components in the gaps between the adjacent electrodes as well as dynamically varying potentials for the horizontal and vertical scansion of the electron beams 53R, 53G and 53B; and for luminance control. These circuits also provide potentials for operation of the dynamically converging gun system according to the invention, as will be described. The potentials are introduced into the tube envelope through ones of the conductive pins 50 that pass through the base 48 of tube 40.

A color cathode ray tube having a planar shadow mask and flat faceplate, to which the present invention is also applicable, is depicted in FIG. 6. This concept is the subject of referent copending applications Ser. Nos. 832,493 and 832,559 of common ownership herewith. A television or monitor system 67 is depicted as having a cathode ray tube 68 with a flat glass faceplate 70. A shadow mask support frame 72 is represented as being secured to faceplate 70 for supporting a shadow mask 73. Faceplate 70 in turn is depicted as being joined to a rear envelope section, here shown as a funnel 74 which tapers down to a narrow neck 76.

Neck 76 is shown as enclosing an electron gun 78 which is indicated as projecting three electron beams 80R, 80G, and 80B on the inner surface 71 of faceplate 70 on which is deposited the screen 82. Screen 82 has a pattern of three compositions of phosphors thereon which emit red, green and blue light when excited by the respective electron beams 80R, 80G, and 80B. An anode button 84 provides for the entrance of a high electrical potential for tube operation. Relatively lower electrical potentials for operation of the electron gun 78 are conducted through the base 86 by means of a plurality of conductive pins 88. A yoke 90 prov;des for the scanning of the electron beams 80R, 80G and 80B across the screen 82 to selectively excite the phosphors deposited there through the medium of the shadow mask 73.

The three electron beams of tubes 40 and 68 shown respectively by FIGS. 4 and 6 are caused to scan a raster on the respective screens 55 and 82. The beams are modulated; that is, the beam current is varied to form the picture display. Beam scanning is a product of horizontal and vertical scansion circuits by which scanning signals are applied to the yoke of the tube, all as is well known in the art. The luminance signal by which the beams are modulated is developed by the television system luminance channel which produces the luminance signals by amplifying the luminance portion of the video signa. The luminance signals control image brightness by controlling the current of the respective electron beams.

The circuits which provide potentials for beam scanning, beam luminance, and which form field components in the gaps between adjacent electrodes, are indicated schematically by block 92. As has been noted, the potentials are applied to the gun components by way of ones of the conductive pins 88. The circuits also provide a variable dynamic convergence signal for operation of the dynamically converging gun system according to the invention, as will be described.

Figure 7:
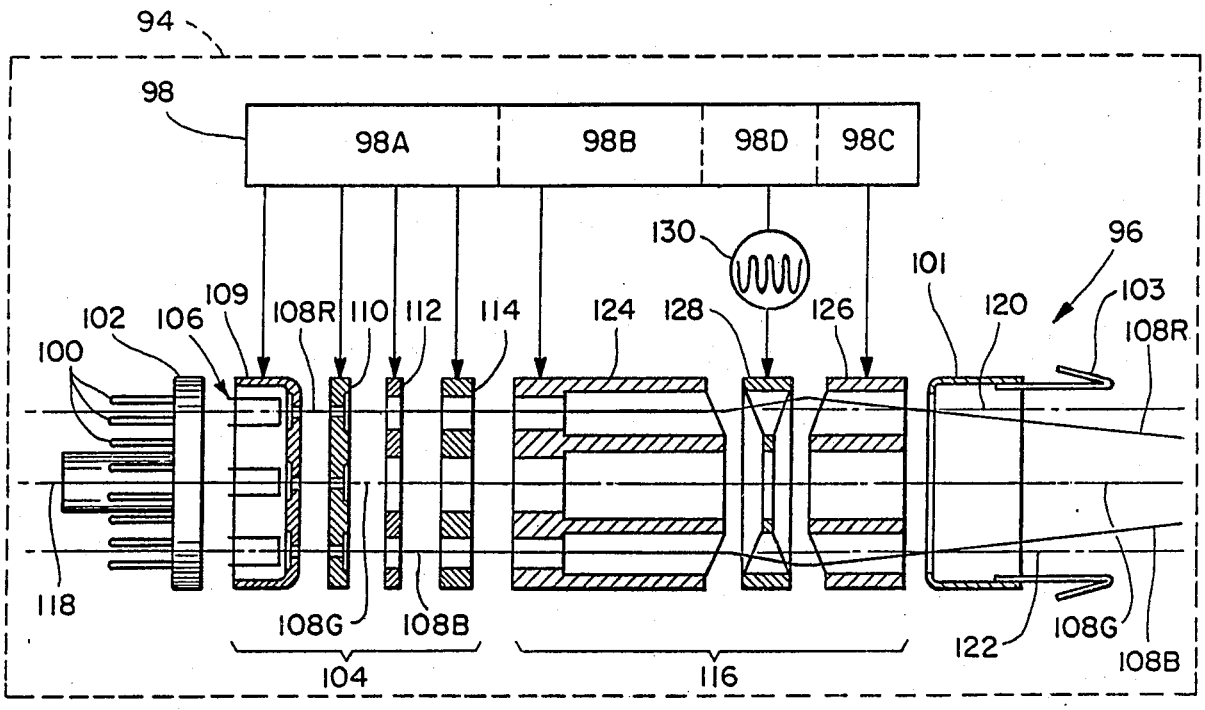
FIG. 7 is a schematized top view of a dynamically converging gun system according to the invention, one that has a three-element extended field main focus lens; the system aspect is indicated by the enclosing dashed line.

A dynamically converging electron gun system 94 according to the invention for use in a color cathode ray tube is depicted in FIG. 7. The gun utilizes the principles of the extended field lens. The gun system 94 can find beneficial application in home entertainment television receiver systems and in monitors that utilize the high-resolution planar foil mask tube, both of which are described heretofore. The gun system 94 comprises basically an electron gun 96, and means for developing and applying the electrical potentials effective to form field components in the gaps between adjacent ones of the electrodes. The means are indicated schematically by the block 98. Also supplied are potentials necessary for tube operation such as filament voltages to energize the cathodes.

The potentials are conducted to the electrodes of gun 96 through selected ones of the electrically conductive pins 100 that pass in vacuum-tight seal through electrically insulative base 102 of tube 96. In this diagram, however, the potentials are indicated for illustrative purpose as being conducted from means 98 directly to the electrodes. The very high potential (e.g., 20–30kV) applied to the final, or "anode" electrode, is typically routed through the anode button in the tube envelope (see Ref. No. 84 in FIG. 6l to the conductive coating on the inner surface of the funnel, from whence it is conducted to the final, anode electrode of the gun through a convergence cup 101 by way of a plurality of gun-centering springs 103 extending from the front of the gun 96.

In a preferred embodiment of the invention, electron gun 96 comprises means 104 including cathode means 106 for developing three in-line electron beams 108R, 108G and 108B. The means 104 for developing the beams is commonly termed the "prefocusing section," which includes in this embodiment of the invention, the cathode means 106, and electrode means 109, 110, 112 and 114. The three electron sources for the beams are generated by thermionic emission of the cathode means 106 as is well known in the art.

Three main focus lens means 116 receive the three in-line beams 108R, 108G and 108B for focusing and converging the beams at the screen of the tube. The main focus lens means 116 each has a like plurality of main focus electrode means spaced along a lens axis parallel to the other lens axes and parallel to a gun center axis 118. Center beam 118G is noted as being in alignment with the gun center axis 118. Please note that the term "main focus lens means" refers to the focus lens structure employed to focus all the beams. The term "main focus electrode means" refers to a discrete individual focus electrode for a single beam, or an allotted portion of a unitized electrode common to others of the beams. The main focus lens means depicted is an extended field lens, the principles of which are described and fully claimed in U.S. Pat. No. 3,995,194, of common ownership herewith.

At least two of the lens axes, shown in FIG. 7 as being two axes—lens axis 120 and lens axis 122—are "off-axis" with respect to the gun center axis 118, Each focus lens means is shown as incuding a focus electrode means 124, an anode electrode means 126, and at least one intermediate electrode means (shown as being one intermediate electrode means 128, in this example) situated between the focus electrode 124 and the anode electrode 126.

The means 98 for developing the potentials which form field components in the gaps between adjacent electrodes, indicated by the block, provide for applying the following typical potentials to the electrodes. Circuit means 98A, indicated as supplying potentials to the prefocus section 104, may provide these typical potentials—

| Ref. No. | Voltage |
|---|---|
| 109 | 0 |
| 110 | 725 |
| 112 | 7,000 |
| 114 | 725 |

It is to be noted that the inventive concept does not depend solely on the use of the four-electrode quadrapotential prefocusing section 104 shown; other prefocusing sections known in the art can as well be used.

The potential on focusing electrode 124, indicated as being supplied by circuit section 98B, typically may comprise a potential of about 7,000 V. This potential is made, by way of example, manually variable about ±400 volts e.g. for the set-up focusing of the three beams 108R, 108G and 108B at the center of the screen, a practice well-known in the art.

The potential applied to the anode electrode 126 is typically 25 kilovolts; this is a fixed potential as supplied by circuit section 98C. The potentials supplied by circuit section 98D to intermediate electrode 128 comprised both a static potential and according to the invention, a dynamic convergence signal 130, as will be described.

Addressing faces on at least two adjacent electrodes of the off-axis lens means, which are depicted as lying on axes 120 and 122, are so structured and arranged according to the invention as to cause the associated ones of the field components to be asymmetrical and effective to significantly converge the off-axis beams 108R and 108B from a straight-line path through a predetermined convergence angle. In the example a gun 96, the addressing faces of electrodes 124 and 128, and 126 and 128, are shown by way of example as being so structured and arranged as cause the field components therebetween to be asymmetrical. It is to be noted that with respect to the center beam 108G, the addressing faces of the electrodes are parallel, so no asymmetry, and hence no divergence, is introduced in the beam path.

The addressing faces of the intermediate electrode means 128 and adjacent eectrodes 124 and 126 are depicted as being parallel and angled relative to center axis 118 so as to create the associated asymmetry. The preferred angle for the main focus lens shown is about 5 degrees. The greater the angle, the greater the effect on field asymmetry and hence convergence.

The asymmetry could as well be introduced by the angling of the addressing faces of just two of the electrodes such as between electrodes 128 and 126. Alternately only one of the addressing faces of an electrode need be at an angle, with the addressing face of the adjacent electrode perpendicular to gun center axis 118.

Figure 7A:
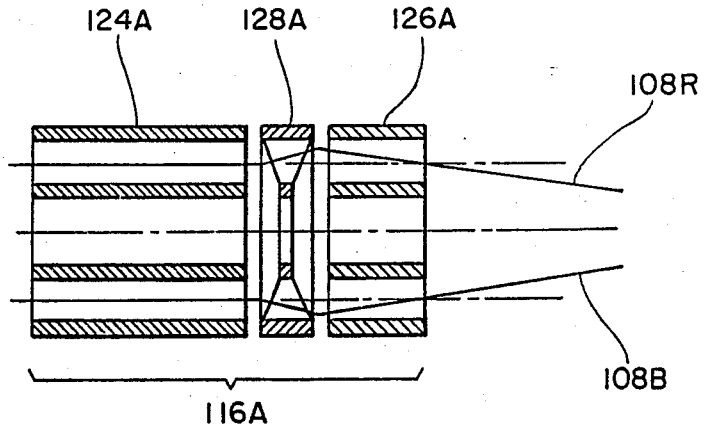
FIG. 7A depicts another embodiment of the main focus lens shown by FIG. 7.

Another embodiment of the invention is depicted in FIG. 7A, wherein there is indicated schematically a three-element main focus lens means 116A. The addressing faces of the intermediate electrode means 128A of each of the off-axis lens means will be seen to be so structured and arranged as to cause the associated field components on both sides of electrode means 128A to be asymmetric and effective to significantly converge the off-axis beams 108R and 108B through a predetermined convergence angle.

Another means of introducing field component asymmetry between adjacent electrodes to cause convergence is to radially offset the apertures of one off-axis electrode means with respect to the apertures of the adjacent electrode. These means for introducing field component asymmetry between adjacent electrodes are fully described and claimed in U.S. Pat. No. 4,058,753 to Blacker et al, of common ownership.

NOTE: The "asymmetry" introduced by either tilting the electrode face(s), or by offsetting the apertures, has very little effect on the symmetry per se of the beam passing therethrough. The effect of field asymmetry in the context of this invention is to cause the off-axis beam to diverge or converge in a desired direction from the axis of the gun producing the beam.

The all-over screen convergence provided by the dynamically converging gun system according to the invention is in consequence of the aforedescribed structure and the development and application of a dynamic convergence signal 130 to the intermediate electrode 128. The means for developing the dynamic convergence signal is indicated as originating in circuit section 98D, as depicted diagramatically in FIG. 7. The dynamic convergence signal 130 is adapted to be correlated with scan of the beams across the screen of the tube. The signal according to the invention causes the strength of the asymmetric field components and thus beam convergence to vary in correspondence with beam deflection.

Figure 8:
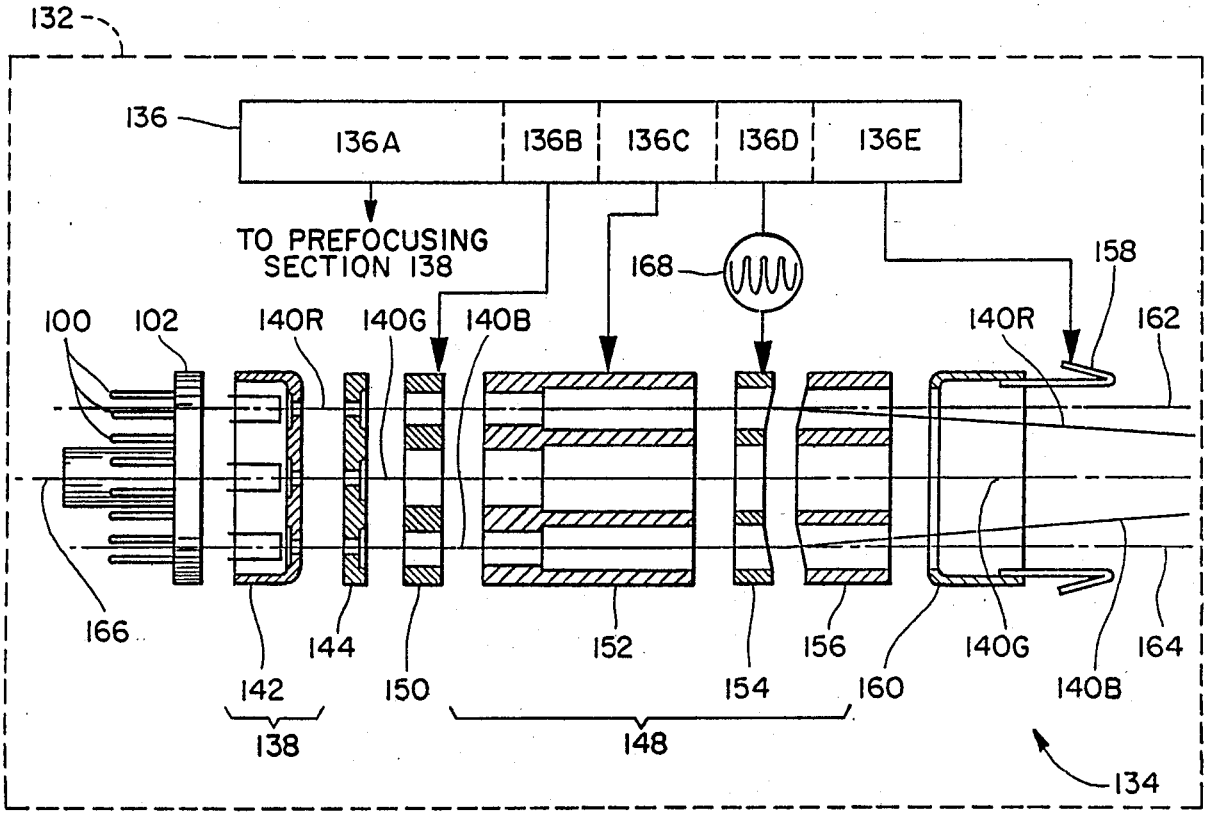
FIG. 8 is a view similar to FIG. 7, except that there is depicted an electron gun having a four-element extended field main focus lens.

FIG. 8 depicts a dynamically converging gun system 132 according to the invention that utilizes the principles of the extended field lens gun described and claimed in referent U.S. Pat. Nos. 3,995,194 and 4,058,753, both to Blacker et al. As with the guns described heretofore, the gun 134 depicted can find useful application in both home entertainment television receiver systems and in monitors, and in tension mask cathode ray tubes. The dynamically converging gun system 132 is similar to the gun system 94 dsscribed heretofore; to avoid needless repetition, only the salient differences in the gun system 132 according to the invention will be described.

Gun system 132 basically comprises a seven-element extended fiel d electron gun 134 and means (indicated by the block 136) for the supplying of necessary voltages for gun operation as well as a dynamic beam convergence voltage, as will be described. Gun 134 consists essentially of means comprising a prefocusing section 138 for developing three electron beams 140R, 140G and 140B; prefocusing section 138 is shown as including three discrete cathodes 142 for beam generation and a control grid 144. Gun 134 also includes four integrated (unitizedl extended field main focus lens means 148, indicated by the bracket, for focusing and converging the three beams 140R, 140G and 140B. The four electrodes of main focus lens means 148 are depicted as comprising a first focusing electrode means 150 for receiving a focusing voltage, and in succession downbeam, a second electrode means 152, and a third electrode means 154 followed by an anode electrode means 156.

Means 136 for supplying operating voltages include section 136A for supplying the prefocusing section 138. Sections 136B–136E provide for developing and applying to the electrode means of each of the focus lens means 150, 152, 154 and 156 potentials which form field components in the gaps between adjacent electrodes. Section 136E is represented schematically as supplying an operating potential to the anode electrode 156 through centering spring 158 which is attached to convergence cup 160, attached physically and electrically to anode electrode 156.

The axes of the off-axis lens means of the main focus lens 148 are indicated by reference numbers 162 and 164. The addressing faces of these off-axis lenses on the third electrode 154 and on adjacent anode electrode 156 are shown as being parallel and angled relative to the central axis 166 of gun 134 so as to create asymmetries in the field components between the electrodes effective to significantly converge the off-axis beams 140R and 140B from a straight line path through a predetermined convergence angle.

Section 136D of the means 136 for developing and applying focus lens potentials provides, in addition to the potential which form field components in the gaps, a variable dynamic convergence signal 168 to third electrode 154 of each off-axis focus electrode means. The signal 168, indicated highly schematically by the parabolic waveform, is adapted to be correlated with the scan of the beams across the screen of the tube. Signal 168 according to the invention causes the strength of the asymmetrical field components to vary and thus the convergence angle and beam convergence to vary in correspondence with beam deflection.

The potentials, both fixed and varying, supplied by the means 136 to the unitized electrodes of the main focus lens 148 may be as follows, by way of example:

| Voltage Supply Section | Supplied to | Voltages Supplied |
|---|---|---|
| 136B | first electrode 150 | 12kVs fixed |
| 136C | second electrode 152 | 7kV fixed* |
| 136D | third electrode 154 | 12kV fixed plus a variable dynamic convergence signal (≈2kV p-p) |
| 136E | anode electrode 156 | 27kV, fixed + |

*May include a dynamic focus voltage waveform (≈300V p-p)

In company with other standard circuits for reproducing television signals, the application and operation of which are well known in the art, the dynamically converging gun system according to the invention has means for developing horizontal and vertical scansion circuits, and deriving a variable dynamic convergence signal from them.

Television receiver systems in which the inventive concept can be advantageously employed comprise well-known types; as a result, details as to the best mode of implementation of the invention can be devoted to a simplified description of suitable circuit means for developing and supplying a dynamic convergence signal in conjunction with widely used television circuits and stages. Although similar in function, details of the types of components used, the specific circuit values, and the operating values of input and output signal voltages thereof will differ significantly among the many brands of television receiver systems currently available. So a description of a basic functional circuit is supplied, the details of which can be readily provided and implemented by one skilled in the art in adapting basic television and monitor circuits to specific receiver systems.

Figure 9:
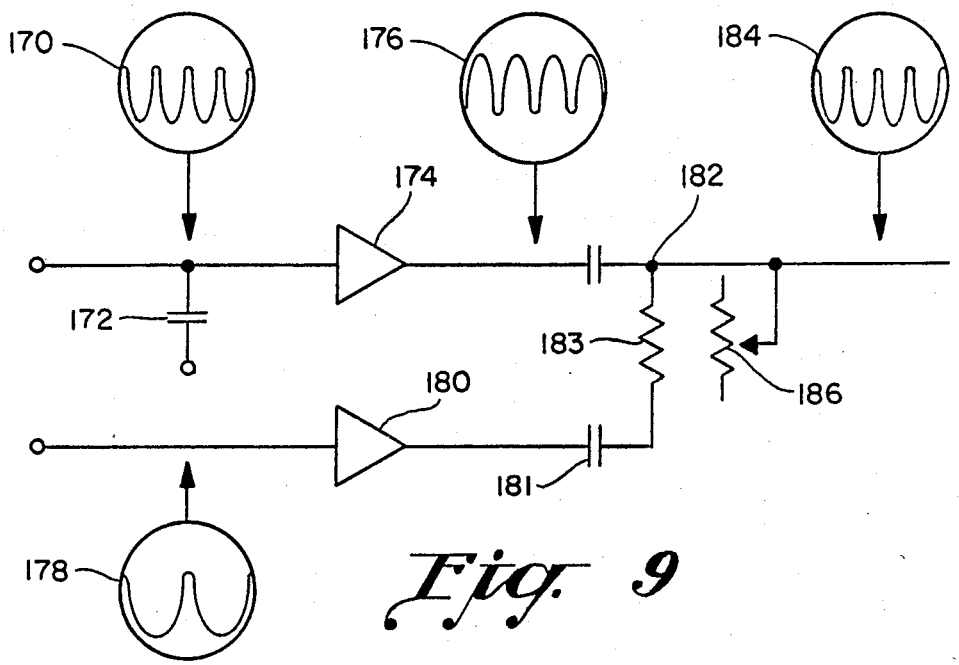
FIG. 9 is schematic diagram of circuit means for forming a variable dynamic convergence signal.

The dynamic convergence signal is essentially a combination of the parabolic waveforms developed by the horizontal and vertical sweep circuits of the television receiver or monitor system. With reference to FIG. 9, which shows schematically a waveform-combining circuit means, there is depicted a fast horizontal sweep waveform 170. This waveform can be taken by sampling the output of the "S" (sweepl capacitor 172 common to most television and monitor sweep circuits. Waveform 170 is in the form of a parabola; the frequency is typically 15 kHz in television receivers, and in the range of 30 to 60 kHz or higher in monitor circuits. Amplifier stage 174 provides for amplification of the sweep waveform to a high voltage. The output waveform 176, shown as being an inverted parabola, has an amplitude of 2,000 volts, by way of example.

The parabola 178 represents the vertical sweep waveform and is taken from a suitable point in the vertical sweep circuits. It is, typically, a "slow" parabolic waveform having a frequency of 60 Hz, or higher. The signals are amplified in amplifier 180 to about 2,000 volts. The output of both amplifiers is AC-coupled through capacitor 181 to the output as indicated, and is combined at point 182. Resistor 183 provides for isolation. The composite signal waveform 184 provides for a dynamic convergence according to the invention by application of the signal to a specified electrode of the main focus lens, as has been described. The voltage level is controlled by a resistive network 186, indicated highly schematically.

The dynamic electrostatic convergence voltage may be generated either by analog or digital electronics. Parabolic waveshapes from analog circuitry has been described. Digitally based correction voltages may be generated based on a ROM (read-only memoryl mapping of the correction voltages needed for discrete, small areas, and covering the entire tube face. The use of ROM mapping to generate correction voltages eliminates the need for symmetry in the correction "waveforms."The principle of ROM correction voltage is that for each position of the scanning beam, there is an index number which prompts the ROM to generate an electrostatic convergence correction voltage appropriate to that beam position. Ideally, this approach, in conjunction with the present invention, can provide a perfectly converged tube. A system for providing suitable correction voltages as described in set forth in U.S. Pat. No. 4,386,368 to Banks.

There are many benefits to be gained by the implementation of the inventive means. For example, a homogenous "uniform-field" yoke can he utilized in lieu of the self-converging yoke. Not only is there a direct cost saving, but also the saving in manufacturing costs as well. Magnets for adjustment of purity and convergence can be made weaker and thus are lower in cost; also, less adjustment time is required and the beams are less subject to distortion. Relatively little time and effort is required for installation of the uniform field yoke—the purity and raster orientation can be done quickly, and without time-consuming tilting of the yoke. No special yoke adjusting machines ("YAM") are required. With regard to performance, less inherent astigmatism is introduced by the uniform field yoke. most important, the size of deflected beam spots is dramatically reduced.

Further with respect to benefits of the invention—with regard to screening of the faceplate using the photoscreening device known as a "lighthouse", the optics can be made simpler. A spherical correction lens can be used, for example, in lieu of the more complex aspheric lens, which may require segmented elements. Also, there less need to "grade" the mask, and any grading can be simpler with a reduced need of alteration of the pitch, size and shape of the apertures to compensate for deficiencies in beam convergence. Further, a systematic and simpler radial distribution of the mask apertures makes for less mask heating and consequent less mask aperture displacement relative to the pattern of phosphor deposits on the screen.

While a particular embodiment of the invention has been shown and described, it will be readily apparent to those skilied in the art that changes and modifications maybe made without departing from the invention in its broader aspects. The aim of the appended claims is to cover all such modifications as fall within the true spirit and scope of the invention.

We claim:

1. An electron gun system for a color cathode ray tube comprising:

means including cathode means for developing an electron beam;

main focus lens means for receiving said electron beam and forming a focused electron beam spot at the screen of the tube, said main focus lens means having a plurality of electrode means situated on a common axis;

means for developing and applying to said electrode means potentials effective to form one or more focusing field components between said electrode means;

said lens means being so structured and arranged as to cause to be formed between adjacent electrode means at least one focusing field component which is asymmetrical and effective to significantly divert a passed beam from a straight-line path through a predetermined angle, a first of said plurality of electrode means comprising focus electrode means adapted to receive focus voltages for establishing the focal distance of said beams, a second of said plurality of electrode means cooperating with another of said plurality of electrode means to form said asymmetrical field component; and means for developing and applying a varying voltage to said second electrode means to cause the strength of said asymmetric field component, and thus said angle by which said beam is diverted, to vary in response to said varying voltage.

2. An electron gun system for a color cathode ray tube having a screen and comprising:

means including cathode means for developing three electron beams;

three main focus lens means for receiving said electron beams and forming three focused electron beam spots at the screen of the tube, said main focus lens mens each having a plurality of electrode means spaced along a lens axis parallel to the other lens axes and parallel to a gun central axis, at least two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen, a first of said plurality of electrode means constituting each of said off-axis main focus lens means comprising focus electrode means adapted to receive focus voltages for establishing the focal distance of the associated off-axis beams, a second of said plurality of electrode means constituting each of said off-axis main focus lens means comprising convergence electrode means cooperating with another of said plurality of electrode means to form said asymmetric field components;

means for developing a dynamic convergence voltage having amplitude variations correlated with a scan of the beams across the screen and for applying said voltage to said convergence electrode means of each of said off-axis focus lens means to cause the strength of said asymmetrical field components affecting said off-axis beams, and thus the distance from the gun at which the beams converge, also to vary, whereby said dynamic convergence voltage causes said beams to dynamically converge with reduced effect on beam focus.

3. A color cathode ray tube system having a screen with multi-color light-emitting phosphor elements thereon, said tube system comprising:

uniform-field yoke means;

a three-beam, in-line electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means spaced along a lens axis parallel to the other lens axes and parallel to a gun central axis, one of which lens axes lies on said central axis, and two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen, a first of said plurality of electrode means constituting each of said off-axis main focus lens means comprising focus electrode means adapted to receive focus voltages for establishing the focal distance of the associated off-axis beams, a second of said plurality of electrode means constituting each of said off-axis main focus lens means comprising convergence electrode means cooperating with another of said plurlity of electrode means to form said asymmetric field components; and means for developing a dynamic convergence voltage having amplitude variations correlated with a scan of the beams across the screen and for applying said voltage to said convergence electrode means of each of said off-axis focus lens means to cause the strength of said asymmetrical field components affecting said off-axis beams, and thus the distance from the gun at which the beams converge, also to vary, whereby said dynamic convergence voltage causes said beams to dynamically converge with reduced effect on beam focus.

4. A color cathode ray tube system having a screen with multi-color light-emitting phosphor elements thereon, said tube system comprising:

uniform field yoke means;

a three-beam electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means spaced along a lens axis parallel to the other lens axes and parallel to a gun central axis, one of which lens axes lies on said central axis, and two of which lens axes are off-axis with respect to said gun central axis;

means for developing and applying to said electrode menas of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen, a first of said plurality of electrode means constituting each of said off-axis main focus lens means comprising focus electrode means adapted to receive focus voltages for establishing the focal distance of the associated off-axis beams, a second of said plurality of electrode means constituting each of said off-axis main focus lens means comprising convergence electrode means cooperating with another of said plurality of electrode means to form said asymmetric field components;

means for developing a dynamic convergence voltage having amplitude variations correlated with a scan of the beams across the screen and for applying said voltage to said convergence electrode means of each of said off-axis focus lens means to cause the strengthof said asymmetrical field components affecting said off-axis beams, and thus the distance from the gun at which the beams converge, also to vary, whereby said dynamic convergence voltage causes said beams to dynamically converge with minimized effect on beam focus, and whereby the use of a uniform field yoke is permitted, with consequent reduced deflection defocusing and distortion of the beams at the sides of the screen.

5. A color cathode ray tube system with a substantially flat faceplate and an associated flat tension shadow mask, said faceplate having a screen with multicolor light-emitting phosphor elements thereon, said tube system comprising:

uniform field yoke means;

a three-beam electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means spaced along a lens axis parallel to the other lens axes and parallel to a gun central axis, one of which lens axes lies on said central axis, and two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen, a first of said plurality of electrode means constituting each of said off-axis main focus lens means comprising focus electrode means adapted to receive focus voltage for establishing the focal distance of the associated off-axis beams, a second of said plurality of electrode means constituting each of said off-axis main focus lens means comprising convergence electrode means cooperating with another of said plurality of electrode means to form said asymmetric field components; and means for developing a dynamic convergence voltage having amplitude variations correlated with a scan of the beams across the screen and for applying said voltage to said convergence electrode means of each of said focus lens means to cause the strength of said asymmetrical field components affecting said off-axis beams, and thus the distance from the gun at which the beams converge, also to vary, whereby said dynamic convergence voltage causes said beams to dynamically converge with reduced effect on beam focus, and whereby the use of a uniform-field yoke is permitted, with consequent reduced deflection defocusing and distortion of the beams at the sides of the screen.

* * * * *